US011243000B2

(12) United States Patent
Sørensen

(10) Patent No.: US 11,243,000 B2
(45) Date of Patent: Feb. 8, 2022

(54) HYDRAULIC MANIFOLD FOR A HYDRAULIC HEATING AND/OR COOLING SYSTEM

(71) Applicant: GRUNDFOS HOLDING A/S, Bjerringbro (DK)

(72) Inventor: Søren Emil Sørensen, Ulstrup (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 0 days.

(21) Appl. No.: 16/668,711

(22) Filed: Oct. 30, 2019

(65) Prior Publication Data

US 2020/0063980 A1 Feb. 27, 2020

Related U.S. Application Data

(63) Continuation of application No. 14/534,518, filed on Nov. 6, 2014, now abandoned.

(30) Foreign Application Priority Data

Nov. 7, 2013 (EP) ..... 13192032

(51) Int. Cl.

| | |
|---|---|
| ***F24D 3/10*** | (2006.01) |
| ***F24D 3/12*** | (2006.01) |
| ***F24D 3/14*** | (2006.01) |
| ***F24H 1/12*** | (2006.01) |
| ***F24D 19/10*** | (2006.01) |

(52) U.S. Cl.

CPC ..... *F24D 3/1066* (2013.01); *F24D 3/1075* (2013.01); *F24D 3/1091* (2013.01); *F24D 3/125* (2013.01); *F24D 3/146* (2013.01); *F24D 19/1021* (2013.01); *F24H 1/12* (2013.01); *Y10T 137/85954* (2015.04); *Y10T 137/87249* (2015.04)

(58) Field of Classification Search

CPC .... F24D 19/1021; F24D 3/1091; F24D 3/125; F24D 3/146; F24H 1/12

See application file for complete search history.

(56) References Cited

U.S. PATENT DOCUMENTS 4,616,325 A * 10/1986 Heckenbach ..... G05D 23/1905 700/276
4,630,221 A * 12/1986 Heckenbach ..... F24F 11/0009 165/223

(Continued)

*Primary Examiner* — Avinash A Savani
*Assistant Examiner* — Deepak A Deean
(74) *Attorney, Agent, or Firm* — McGlew and Tuttle, P.C.

(57) ABSTRACT

A hydraulic manifold for a hydraulic heating and/or cooling system includes a feed conduit (212) and a return conduit (216). The feed conduit (212) includes at least one feed connection (258), and the return conduit (216) includes at least one return connection (260), for the connection of a load circuit (228). A load module (204), in which a section of the feed conduit (212) with the feed connection (258), and a section of the return conduit (216) with the return section (260) are formed, includes at least one mixing device with a pump (232) and with a regulating valve (230), to admix fluid from the return connection (260) to a fluid flow from the feed conduit (212) to the feed connection (258). The section of the feed conduit (212) and the return conduit (216) in each case include an additional contact for connection with a further load module.

20 Claims, 5 Drawing Sheets

(56) References Cited

U.S. PATENT DOCUMENTS

| | | | | |
|---|---|---|---|---|
| 5,119,988 | A * | 6/1992 | Fiedrich | G05D 23/126 237/59 |
| 6,062,485 | A * | 5/2000 | Stege | F24D 19/1015 237/2 A |
| 6,220,520 | B1 * | 4/2001 | Gibbs | F24D 3/1066 237/19 |
| 6,345,770 | B1 * | 2/2002 | Simensen | F24D 3/1066 237/69 |
| 6,463,999 | B1 * | 10/2002 | Jung | B29C 35/007 165/137 |
| 7,048,200 | B2 * | 5/2006 | Sweet | F24D 3/1058 237/69 |
| 7,191,789 | B2 * | 3/2007 | Corbett, Jr. | F24D 3/1058 137/15.01 |
| 7,507,066 | B2 * | 3/2009 | Koenig | F04D 29/426 415/60 |
| 8,342,419 | B2 * | 1/2013 | Simensen | F24H 9/06 237/69 |
| 9,404,664 | B2 * | 8/2016 | Jonsson | F25B 30/02 |
| 9,477,242 | B2 * | 10/2016 | Kovalcik | F24H 8/00 |
| 2004/0216784 | A1 * | 11/2004 | Corbett, Jr. | F24D 3/1058 137/599.11 |
| 2005/0257843 | A1 * | 11/2005 | Simensen | F24D 3/1066 137/884 |
| 2008/0086981 | A1 * | 4/2008 | Kilkis | F24F 13/068 52/791.1 |
| 2009/0020270 | A1 * | 1/2009 | Strelow | F24D 19/1024 165/104.31 |
| 2009/0287355 | A1 * | 11/2009 | Milder | F24D 19/1051 700/277 |

* cited by examiner

HYDRAULIC MANIFOLD FOR A HYDRAULIC HEATING AND/OR COOLING SYSTEM

CROSS REFERENCE TO RELATED APPLICATIONS

This application is a continuation application and claims the benefit of priority under 35 U.S.C. § 120 of U.S. patent application Ser. No. 14/534,518 filed Nov. 6, 2014, which claims the benefit of priority under 35 U.S.C. § 119 of European Patent Application EP 13 192 032.4 filed Nov. 7, 2013, the entire contents of which are incorporated herein by reference.

FIELD OF THE INVENTION

The invention relates to a hydraulic manifold for a hydraulic heating and/or cooling system with a feed conduit and a return conduit, wherein the feed conduit comprises at least one feed connection, and the return conduit comprises at least one return connection, for the connection of a load circuit.

BACKGROUND OF THE INVENTION

Hydraulic manifolds for example are known in floor heating insulations for example, from which manifolds the individual load circuits or floor heating circuits extend. The hydraulic manifold thereby creates the connection of a plurality of load circuits to the heating system. The known manifolds as a rule are designed essentially of two pipes, of which one functions as a feed and the other as a return. Connections for the individual load circuits are arranged on the pipes. Thereby, each load circuit is connected to a connection on the feed and to a connection on the return.

Moreover, in floor heating systems, it is known to use mixing devices or mixers which admix colder water from the return to the fluid functioning as a heat transfer medium, in the feed, in order to lower the feed temperature. Such mixers are particularly necessary if the floor heating is used in combination with normal radiators, since the floor heating requires a lower feed temperature than normal radiators. In known floor heating systems thereby, a central mixer is applied, which is arranged upstream of the hydraulic manifold or of the feed in the hydraulic manifold. The feed temperature made available for the floor heating by the mixer is set either in dependence on a room temperature probe in a room, or in a manner dependent on the outside temperature. The temperature of the rooms to be heated is usually set by way of opening and closing the individual circuits of the floor heating.

SUMMARY OF THE INVENTION

It is an object of the invention, to improve such a heating and/or cooling system, to the extent that the energy consumption can be reduced, and moreover the heating and/or cooling comfort can be improved in rooms to be thermally regulated.

The hydraulic manifold according to the invention is envisaged for use in a hydraulic heating and/or cooling system which comprises a pipe conduit system, in which a fluid heat transfer medium, for example water circulates. Thereby, it can be the case exclusively of a heating system, such as a floor heating for example or exclusively of a cooling system, or also of a combined system which permits a cooling as well as a heating of locations or rooms. Thus, the system can be used for heating in winter and for cooling or for temperature conditioning in summer.

The hydraulic manifold according to the invention comprise a feed conduit and a return conduit, wherein the feed conduit comprises at least one feed connection and the return conduit at least one return connection. The feed connection and the return connection serve for connecting a load circuit, for example a floor heating circuit. Then, the feed or the entry of the load circuit is connected to the feed connection, and the exit or return of the load circuit is connected to the return connection. Preferably, several feed connections are formed on the feed conduit and several return connections on the return conduit, in order to be able to connect several load circuits onto the hydraulic manifold.

The hydraulic manifold, according to the invention, comprises at least one load module, in which a section of the feed conduit with at least one feed connection, and a section of the return conduit with a return connection are formed. I.e. the load module serves for connecting a load circuit onto the manifold. Accordingly, preferably several load modules are provided in the case that several load circuits are present. The at least one load module according to the invention comprises a mixing device with a pump and with a regulating valve which is designed to admix fluid from the return connection to a fluid flow from the feed conduit to the feed connection. Such a mixing device, in the case of a heating system serves for reducing the feed temperature of the fluid or of the liquid from the feed conduit by way of admixing colder liquid from the return connection. Vice versa, in the case of a cooling system, the mixing device can be used to increase the feed temperature of a cold liquid flowing in through the feed conduit, by way of admixing warmer liquid from the return connection. Thus, the feed temperature of the liquid serving as a heat transfer medium can be individually set for the load circuit connected to the load module, by way of the mixing device. The regulating valve serves for setting and is arranged such that the degree of admixing of liquid from the return connection can be varied by way of its actuation. Thus, a temperature setting or a temperature regulation for the load circuit is possible. The arrangement of the mixing device directly on the load circuit has the advantage that an individual temperature adaptation for this load circuit is possible, and this is not possible with a central mixer. Moreover, the arrangement of the mixing device in the hydraulic manifold has the advantage that the feed conduit to the hydraulic manifold can be integrated into a normal heating and/or cooling system without any problem. For example, with a heating installation, it is not necessary to lay a separate feed conduit to the hydraulic manifold, from a central mixer. In contrast, the hydraulic manifold can be connected to common heating conduits, which lead to radiators for example. Thus, the installation is simplified.

Furthermore, the load module comprises connection for a further load module. Thus, the section of the feed conduit offers an additional connection and the section of the return conduit offers an additional connection which in each case can be connected with corresponding connections of further, especially identical load modules. These additional connections are preferably formed as hydraulic couplings, as described below. Thus, it is possible to string multiple load modules with one another, whereas the sections of the feed conduit and the sections of the return conduit of the respective load modules are connected via additional connections with one another.

According to the preferred embodiment at least a part of the pump and a part of the regulating valve are arranged in a single unitary housing. Preferably, the impeller of the pump and at least one element of the regulating valve are arranged in a unitary housing part. Preferably, all hydraulic parts of the pump and the regulating valve are arranged in the same housing part. Thus, the number of parts is reduced and the assembly of the device is simplified.

Preferably, the manifold comprises several load modules which are preferably releasably connected to one another in a manner such that the sections of the feed conduit are connected to one another in each case and the sections of the return conduit are connected to one another in each case. Preferably, a separate load module with a mixing device is provided for each load circuit. Thus, for each load circuit, the feed temperature can be individually set and adapted to the heat requirement or cooling requirement of the individual load circuit. An individual regulation for the individual load circuits or for the rooms to be thermally regulated by the load circuits is possible with this, from which energy savings and a gain in comfort result. The preferably modular construction of the hydraulic manifold according to the invention with individual load modules has the advantage that the hydraulic manifold can be simply adapted to the necessary number of load circuits, so that one does not need to keep available special hydraulic manifolds for different numbers of load circuits. In contrast, load modules can be connected to one another in the necessary number, in order to construct a hydraulic manifold with the desired number of load modules. The load modules are preferably releasably connected to one another so that they can be easily exchanged in the case of defects. This it is not necessary to exchange the complete hydraulic manifold.

Further preferably, the at least one load module is connected preferably in a releasable manner to a main module which comprises a control device and/or an entry for the feed conduit and/or an exit for the return conduit. I.e. the main module preferably serves for the connection of the hydraulic manifold to supply conduits which create the feed and the return to the hydraulic manifold from a heating and/or cooling installation. The at least one load module is preferably connected to the main module such that the section of the feed conduit in the load module is connected to an entry for the feed conduit on the main module, in a fluid-leading manner. Alternatively or additionally, the section of the return conduit in the load module can be connected to the exit for the return conduit on the main module, in a fluid-leading manner. Preferably, the section of the feed conduit as well as the section of the return conduit, in the load module, is hydraulically connected to the main module in the mentioned manner. The hydraulic connection is preferably created via releasable couplings, in particular plug-in couplings. Preferably, the load modules are designed in a manner such that at one side they comprise hydraulic couplings for connection to the main module and at an opposite end comprise hydraulic couplings for connection to a further load module. Thereby, the hydraulic couplings for connection to a further load module are usefully designed identically to the hydraulic couplings on the main module. Thus, several load modules can be applied onto one another in series, wherein preferably the sections of the feed conduit and the sections of the return conduit of the put-together load modules form a continuous feed conduit and a continuous return conduit. This permits the construction of a hydraulic manifold of a different length, depending on how many load modules are applied on one another.

Alternatively or additionally, the main module comprises a control device, such as a manifold control device as described below. Moreover sensors, for example temperature detectors are preferably arranged in the main module which determine the temperature in the feed conduit and/or the return conduit. Such sensors are signal-connected with the control device in a manner such that the control device directly engages the temperatures in the main module.

According to a further preferred embodiment, a manifold control device is present, which is designed for the control of the regulating valve and/or of the pump in the at least one, preferably several load modules. Alternatively, the load modules can also comprise their own independent control devices. The arrangement of a central manifold control device which controls the mixing devices of the load modules however has the advantage that only one control device needs to be provided for several load modules. Moreover, the control can control or regulate several load modules in this context, for example in order to ensure that the heating and/or cooling energy which is available is distributed in the desired manner to the several load circuits. In the above-described manner, the admixing degree of liquid or fluid out of the return to the feed is set by way of the control of the regulating valve. The control can moreover be designed for example such that the manifold control device switches the pump on and off, in order to switch the associated load circuit on and off Particularly preferably, a speed regulation of the pump is envisaged, by which means additionally the flow or volume flow through the load circuit can be set by the manifold control device, so that the quantity of the fed heat transfer medium, i.e. of the fluid, can be adapted to the requirements of the respective load circuit by way of regulation of the pump.

The manifold control device is signal-connected to the load modules or to the electrical components which are arranged in the load modules, specifically to the pump and/or to the regulating valve, wherein the connection in particular is effected via a data bus. Thus, a transmission of control signals from the manifold control device to the load module or to its components to be controlled or regulated is possible. Further preferably, in the reverse direction, a transmission of condition data or sensor signals can be effected via the signal connection. For example, feedbacks on the operating condition of the regulating valve and/or of the pump to the manifold control device can be effected. For example, the opening degree of the regulating valve or the current speed of the pump can be fed back. Particularly preferably, additionally sensors, for example temperatures sensors can be provided in the load modules, and the signals of these sensors transmitted to the manifold control device. For example, a temperature sensor can be arranged in the return connection or in the flow path between the return connection and the section of the return connection in the load module, in order to detect the exit temperature of the heat transfer medium or fluid from the load circuit. The signal-connection via a data bus is particularly advantageous if different numbers of load modules are to be applied or rowed onto one another in the manner described above. Such a data bus which then preferably extends over all load modules, permits signals to be led further to other load modules via individual load modules.

Each load module preferably comprises a module control device or a communication unit, which can be unambiguously addressed by the manifold control device, in order to be able to exchange data and/or signals with the load module. The addressing is effected preferably in an automatic manner. Particularly preferably, the manifold control device is designed such that it recognizes a connected load module and automatically assigns an address to the load module or to its module control device. Alternatively or additionally, actuation elements which permit a manual activation of the coupling procedure can be provided on the manifold control device and/or on the load module.

Particularly preferably, the manifold control device is arranged in the main module. The main module thus apart from the hydraulic connection for the load modules also forms a central control device for preferably the complete hydraulic manifold. Suitable electrical connections, in particular releasable plug-in connections can be present for the electrical or signal connection between the main module and the load module. Further preferably, the load modules, on a longitudinal end which is opposite the main module also comprise corresponding electrical plug-in connections which permit the electrical connection to an adjacent further load module. Thus, an electrical supply lead for the electrical components of the load modules can expend departing from the main model over the plug-in connections through all load modules. Simultaneously, in this manner a data bus can extend through the individual load modules, in a manner departing from the main module. The data bus thereby can likewise be effected via an electrical connection, or however also via another suitable connection, for example an optical connection. According to a particularly preferred embodiment of the invention, at least one temperature sensor is arranged in the at least one load module and this sensor is signal-connected to the manifold control device, in particular via a data bus. This for example can be a temperature sensor in the return of the load circuit.

Preferably, a temperature sensor is arranged in the load module in a manner such that it detects the temperature of a fluid flowing through the feed connection into the connected load circuit. I.e. a temperature sensor is preferably situated in the flow path from the mixing device to the feed connection, so that it detects the temperature of the fluid mixed by the mixing device. This permits a temperature regulation via the manifold control device, since the temperature set via the regulating valve in the load module is detected by the temperature sensor and thus a feedback is given to the control device. Additionally, a further temperature sensor as described can be provided in the return.

Preferably, the manifold control device is preferably designed to set the temperature of a fluid flow through the feed connection by way of activating the regulating valve in the at least one load module. This is thereby preferably effected in cooperation with the previously described temperature sensor. Particularly preferably, the manifold control device controls or regulates the regulating valves of several load modules, so that the temperatures at the feed connections of the individual load modules can be set centrally by the manifold control device.

Further preferably, the manifold control device is designed, in order to set a fluid flow or volume flow through the feed connection into the connected load circuit by way of activating the pump in the load module. Here too, the activation of the pumps of several, preferably all load modules by the manifold control device is effected such that this functions as a central control for all load circuits and in particular the fluid flows through the individual load circuits can be set in a manner adapted to one another, in the case that several load modules are provided. This is preferably effected by way of the speed control of the individual pumps, as described above.

According to a preferred embodiment, the manifold control device comprises at least one communication interface for receiving signals from at least one external control element, in particular from a room thermostat. Thus, it is possible to arrange room thermostats which detect the current temperature in the rooms and transmit the temperature values to the manifold control device as the case may be, in the rooms to be thermally regulated by the load circuits. Particularly preferably, the room thermostats are designed such that they permit the setting of a desired temperature for the respective room. Given a deviation from this desired temperature, the room thermostat via the communication interface sends a corresponding signal to the manifold control device which then in a dependent manner accordingly activates the load circuits associated with to the room or rooms, and for this the described pump is switched on in this load circuit and then the adaptation of the feed temperature in the load circuits is carried out via activation of the regulating valve or valves. The communication interface can be designed as a wired interface or for example also as a radio interface. Preferably, several control elements, in particular several room thermostats communicate with the communication interface of the manifold control device. An assignment of the individual room thermostats to the connected load modules is accordingly stored or set in the control device.

According to a further preferred embodiment of the invention, the main module comprises an energy supply for the pump and/or for the regulating valve in the at least one load module, preferably several load modules. The electrical energy supply can for example be effected via a mains connection lead which is provided on the main module, via suitable electrical connections, for example plug-in contacts on the main module, to the load module, and then from the load module to further load modules connected as the case may. In the case that the load modules or their electrical and electronic components are not operated with the mains voltage, it is preferably for a suitable mains part to be arranged in the main module for energy supply, and for this mains part to deliver the desired, preferably lower output voltage which the load modules require as an energy supply. This, in particular, has the advantage that only one central mains part needs to be provided. Moreover, the electrical connections between the main module and the load module or the load modules do not have to be designed for mains voltage, which simplifies the construction due to the lower demands with regard to insulation.

The pump in the at least one load module is preferably arranged in a flow path between a mixing point, in which a flow path from the feed conduit and a flow path from the return connection meet, and the feed connection. Due to this arrangement, one succeeds in the pump being able to suck fluid through the connection to the return connection as well as through the connection to the feed conduit.

The regulating valve in the load module is preferably arranged in a flow path from the return connection to a mixing point, in which a flow path from the feed conduit and the flow path from the return connection meet, or in the flow path from the feed conduit to the mixing point. If the flow through the regulating valve is reduced, and the pump simultaneously produces a constant fluid flow, a correspondingly greater share is then sucked by the pump via the mixing point out of the flow path, in which no regulating valve is arranged. If, for example, the regulating valve is situated in the flow path from the return connection to the mixing point, and the pump is situated downstream of the mixing point in the flow path to the feed connection, the pump will suck fluid exclusively from the connection from the mixing point to the feed conduit, if the regulating valve is closed. If the regulating valve is opened, a share which is proportional to the opening degree is sucked via the regulating valve out of the return connection. Thus, the mixing ratio at the mixing point can be varied and accordingly the feed temperature can be changed.

With regard to the regulating valve, it is preferably the case of a motorically, in particular electromotorically driven valve. A stepper motor for example can be provided as a drive motor, for the valve, so that the regulating valve can be opened and/or closed in defined steps. Thereby, a defined opening degree which is in particular proportional to an activation signal sets in at the regulating valve.

The invention is hereinafter described in more detail by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
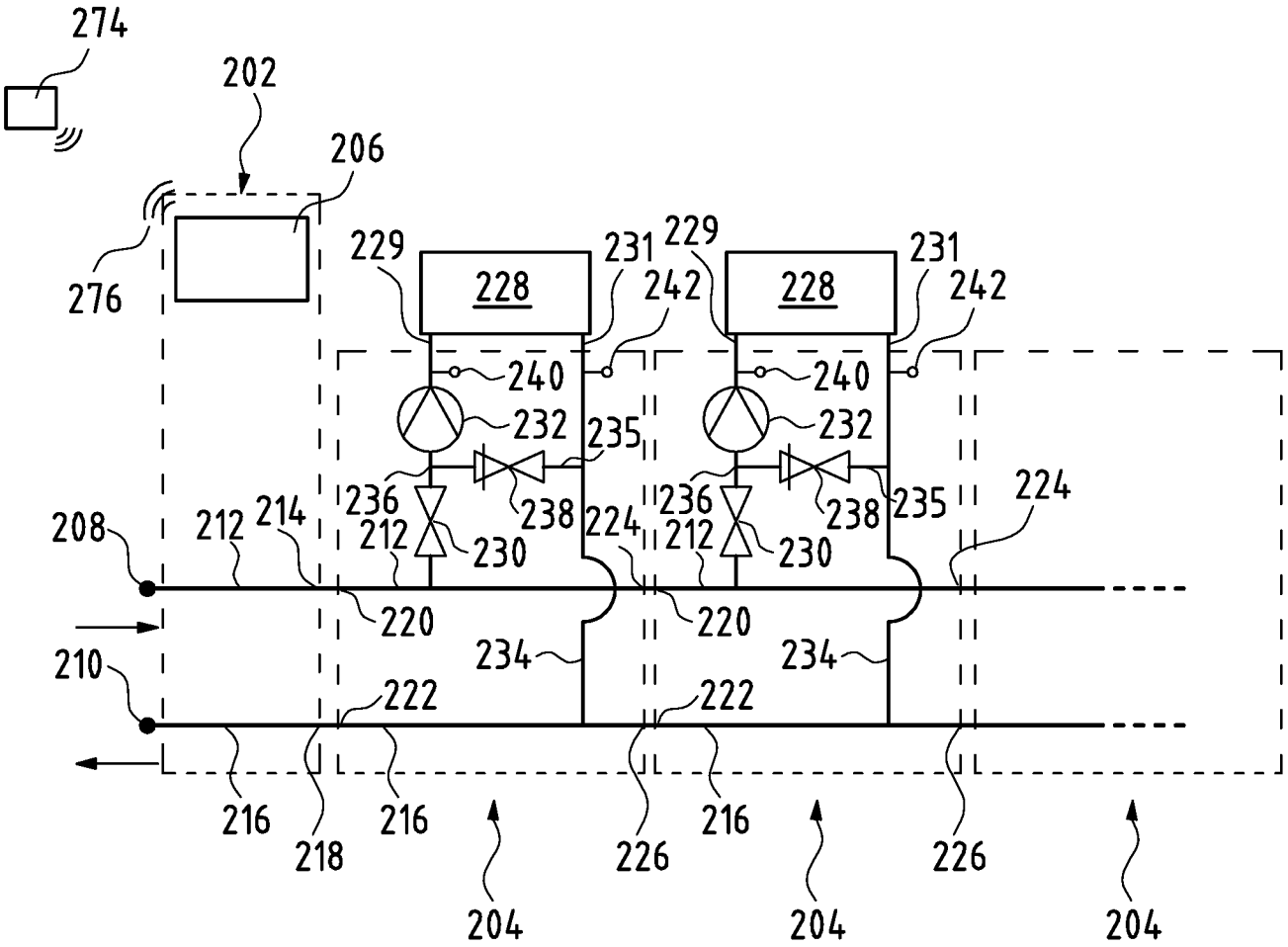
FIG. 1 is a schematic view showing a hydraulic manifold according to the invention.

Referring to the drawings, the shown hydraulic manifold, which is described by way of example, is constructed in a modular manner. The hydraulic manifold comprises a main module 202 as well as several load modules 204. The main module 202 serves for the hydraulic and electrical connection of the load modules 204 and comprises a control device 206 which serves as a manifold control device for the control of the several load modules 204. The main module 202 moreover comprises a feed connection 208 as well as a return connection 210. The main module 202 with the feed connection 208 and the return connection 210 is connected onto a heating or cooling installation. Thereby, thermally regulated fluid is fed through the feed connection 208 and after flowing through one or more load circuits the fluid flows through the return connection 210 back into the heating or cooling installation. In the main module 202, in each case a temperature sensor which detects the feed temperature and return temperature can be arranged on the section of the feed conduit 212 and/or on the section of the return conduit 216. These sensors can be signal-connected to the manifold control device 206. Thus, the manifold control device 206 can directly detect the temperatures in the main module.

The hydraulic manifold is hereinafter described by way of the example of a heating installation. However, it is to be understood that the hydraulic manifold accordingly could also be applied in a cooling installation, or in a combined heating and cooling installation. In a heating installation, heated fluid, in particular heated water, for example from a boiler or a heat reservoir, is fed to the feed connection 208. The fluid, after flowing through the heat exchanger in the rooms or buildings to be heated, flows back through the return connection 210 to the boiler or heat reservoir.

The feed connection 208 in the inside of the main module 202 is connected to an outlet 214 by way of a section of the feed conduit 212. Accordingly, the return connection 210 is connected via a section of a return conduit 216 in the inside of the main module 202 to an inlet 218. The outlet 214 and the inlet 218 are designed as hydraulic couplings on a side of the main module 202 which faces an adjacent load module 204. The load modules 204 in their inside likewise comprise a section of a feed conduit 212 and a section of a return conduit 216. The sections of the feed conduit 212 as well as of the return conduit 216 extend in the longitudinal direction through the load modules 204. At a first side, the sections of the feed conduit 212 and of the return conduit 216 are connected to first hydraulic couplings. Thereby, the section of the feed conduit 212 at the first end is connected to the first feed coupling 220, and the section of the return conduit 216 on the same side is connected to a first return coupling 222. The first feed coupling 220 is engaged with the outlet 214 of the main module 202, whereas the first return coupling 222 is in engagement with the inlet 218 of the main module 202, in order to create a fluid-leading connection.

The load modules 204 at a longitudinal end which is opposite the first feed coupling and at the longitudinal end which is opposite the first return coupling 222 comprise a second feed coupling 224 as well as a second return coupling 226. The second feed coupling 224 forms the axial end of the section of the feed conduit 212 in the load module 204, said axial end being opposite to the first feed coupling 220, whereas the second return coupling 226 forms the axial end of the section of the return conduit 216 in the load module 204, said axial end being opposite to the first return coupling 222. The several load modules 204 are all designed the same. This means that the design and arrangement of the second feed coupling 224 as well as of the second return coupling 226 in its design corresponds to the arrangement of the outlet 214 as well as of the inlet 218, on the main module 202. Thus, it is possible to apply a load module 204 either onto the main module 202 or onto another load module. Thus, several load modules can be rowed onto one another in the longitudinal direction. An arrangement of two load modules 204 is shown in FIG. 1, wherein further load modules 204 are indicated schematically. Six load modules 204 are arranged on a main module 202 in the embodiment example according to FIGS. 2 and 3.

The essential feature of the load modules 204 which are shown in the arrangements according to FIGS. 1 to 7 is moreover the fact that each load module 204 comprises an integrated mixing device for the temperature setting of the feed temperature for an associated load circuit 228. The mixing device, in a flow path from the feed conduit 212 to the entry/load feed connection 229 of the load circuit 228 comprises a regulating valve 230 and a circulation pump 232 downstream of this valve 230. The circulation pump 232 serves for delivering fluid from the feed conduit 212 through the load circuit 228 and via the return/module return line 234 back into the return conduit 216. The mixing device moreover comprises a connection from the return 234 to a mixing point 236, wherein the mixing point 236 is situated in the flow path between the regulating valve 230 and the circulation pump 232. A check valve 238 is situated in the connection 235 and has the effect that a flow through the connection 235 is possible only in the direction from the return 234 to the mixing point 236.

The regulating valve 230 is signal-connected to the manifold control device 206 for its activation. I.e. the manifold control device 206 activates the regulating valve 230, in order to set a desired feed temperature at the entry 229 of the load circuit 228. This feed temperature at the entry 229 is detected by a temperature sensor 240. If the regulating valve 230 is completely closed, the circulation pump 232 delivers fluid exclusively via the connection 235 in the circuit through the load circuit 228. If the regulating valve 230 is opened, simultaneously a fluid flow is sucked out of the feed conduit 212, and a fluid flow is sucked out of the connection 235, by the circulation pump 232. Thereby, the fluid from the return 234 is thus admixed via the connection 235 to the fluid from the feed conduit 212, so that the feed temperature of the fluid from the feed conduit 212 is changed. In the case of a heating system, the feed temperature in the feed conduit 212 is usually greater than in the return 234, i.e. in this case colder fluid from the return 234 is admixed via the connection 235 to the flow from the feed conduit 212, so that the feed temperature is lowered. Vice versa, in a cooling system, the feed temperature of the fluid from the feed conduit 212 can be increased by way of admixing warmer fluid from the return 235. The share of fluid which is fed from the feed conduit 212 to the mixing point 236 can be varied by way of changing the opening degree of the regulating valve 230. Accordingly, a greater or smaller share of the delivery flow is sucked via the connection 235, given a constant delivery rate of the circulation pump 232, by which means the temperature of the fluid at the entry 229 of the load circuit 228 can be changed by way of changing the mixing ratio of the two flows at the mixing point 236. The actually set temperature thereby is detected by the temperature sensor 240. The detected temperature value is communicated to the manifold control device 206 for regulation, via a suitable signal connection. The manifold control device 206 in this manner regulates the individual load modules 204 in an independent manner, so that the feed temperature for the individual load circuits 228 can be individually regulated or set.

Moreover, in this embodiment example, a second temperature sensor 242 is arranged at the exit of the load circuit 248. This too, is preferably signal-connected to the manifold control device 206 and detects the exit temperature out of the load circuit 288. It is possible to determine the temperature difference across the load circuit 228 and for example to regulate the volume flow delivered by the circulation pump 232 in a manner depending on this temperature difference, due to the fact that the entry temperature and the exit temperature of the load circuit 228 are detected. For this, preferably the circulation pump 232 is also activated by the control device 206 via a suitable signal-connection, in particular in order to set the speed of the circulation pump 232. The flow can be set individually for each load module by way of a speed change of the respective circulation pump 232.

The design construction of the hydraulic manifold described by way of FIG. 1 is described in more detail by way of FIGS. 2 to 7. The main module 202 comprises a hydraulic section 250 as well as an electronics housing 252, in which the control device or manifold control device 206, and, as the case may be, further components for the energy supply, for example a mains part, are arranged. The hydraulic section 250 is preferably designed as a single-piece component of plastic and comprises the feed connection 208 as well as the return connection 210 on one side. The feed connection 208 and also the return connection 210 are designed as hydraulic couplings for the connection of supply conduits, which create the connection to a heating installation or cooling installation. The inlet 218 as well as the outlet 214 is arranged on a second side surface of the hydraulic section 250. The outlet 214 is connected to the feed connection 208 via a channel in the inside of the hydraulic section 250, whereas the inlet 218 is connected to the return connection 210 via a further channel in the inside of the hydraulic section 250. As is described above the outlet 214 and the inlet 218 are designed as hydraulic couplings for the pluggable connection of a load module 204. For this, the first feed coupling 220 of an adjacent load module 204 engages into the outlet 214, and a first return coupling 220 of an adjacent load module engages into the inlet 218. The outlet 214 and the inlet 218 in this example are in each case designed as a female part of a plug-in coupling. Accordingly, the first feed coupling 220 and the first return coupling 222 are in each case designed as male parts of a hydraulic plug-in coupling. A mechanical connection between the main module 202 and the load module 204 is created by way of sticking the couplings into one another. Seals, in particular O-rings which are not shown in more detail here, are arranged in the couplings.

The load module 204 also comprises a housing part which is manufactured as one piece of plastic and which serves as a pump housing for the circulation pump 232 and in its inside comprises the necessary flow paths and in particular the sections of the feed conduit 212 as well as of the return conduit 216. The drive of the regulating valve 230 as well as the stator housing 256 of the circulation pump 232 projects out of the housing part 254. The housing part 254 on a longitudinal end comprises the first feed coupling 220 and the return coupling 222, and at an opposite longitudinal end the second feed coupling 224 as well as the second return coupling 226, wherein the second feed coupling 224 and the second return coupling 226 in a manner corresponding to the outlet 214 and the inlet 218 on the main module 202 are formed as female parts of a hydraulic plug-in coupling. It is possible to stick identically designed load modules 204 either directly onto the main module 202 or onto a further load module 204, since the second feed coupling 224 and the second return coupling 226 are shaped and arranged in a manner corresponding to the outlet 214 and the inlet 218, wherein then the first feed coupling 220 of a second load module engages into the second feed coupling 224 of a first load module, and the first return coupling 222 of a second load module engages into the second return coupling 226 of a first load module. Thus several load modules can be stuck onto one another, in order to form a hydraulic manifold with the desired number of connections for load circuits 228. The number of the load modules 204 is thereby essentially limited by the configuration of the control device 206. The housing part 254 of the load module 204 moreover comprises a load feed connection 258 and a load return connection 260. Accordingly, the entry 229 of a load circuit 228 is connected to the load feed connection 258, whereas an exit 231 of the load circuit 228 is connected to the load return connection 260.

Figure 2:
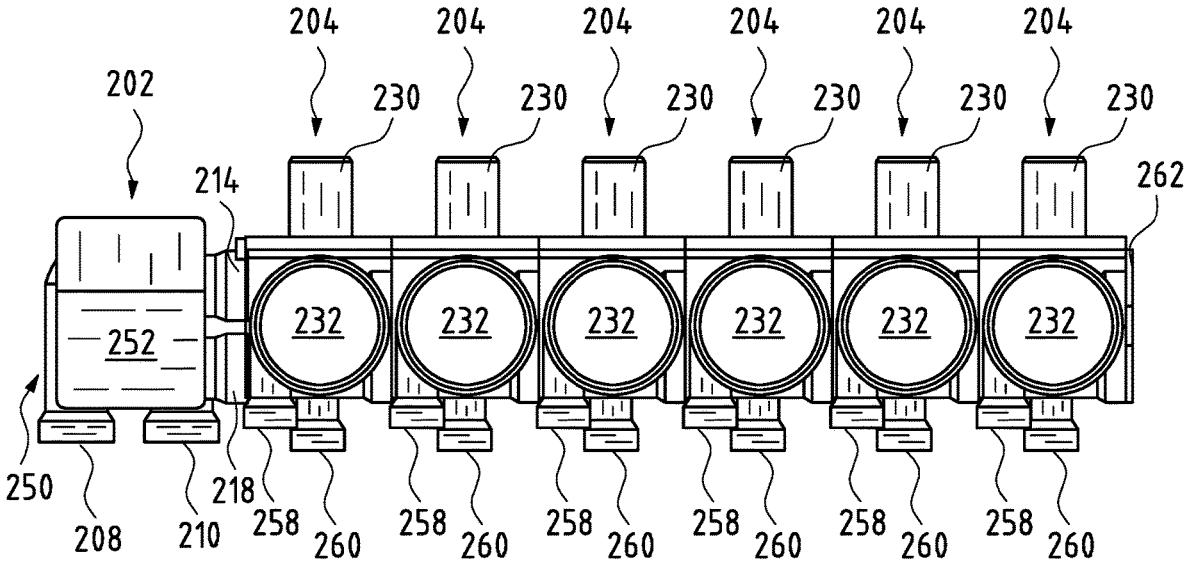
FIG. 2 is a plan view of a hydraulic manifold according to the invention.
Figure 3:
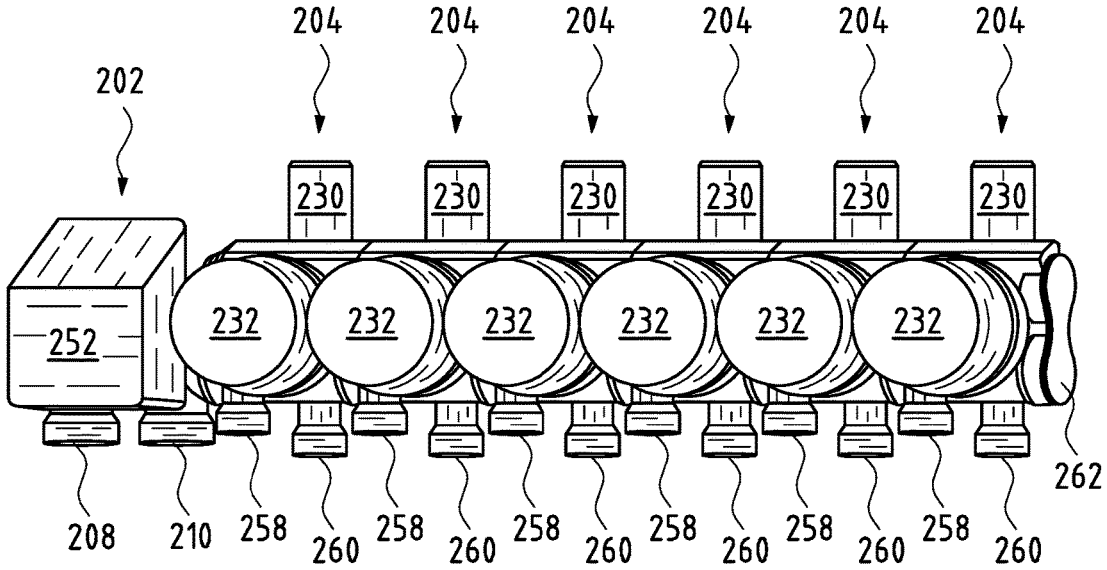
FIG. 3 is a perspective view of the hydraulic manifold according to the invention.
Figure 5:
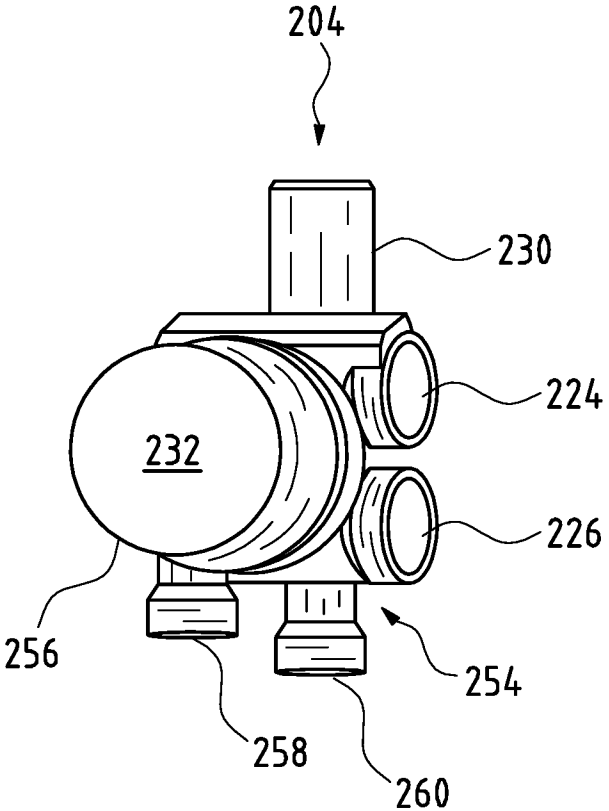
FIG. 5 is a perspective view of the load module of the hydraulic manifold according to FIGS. 2 and 3.
Figure 4:
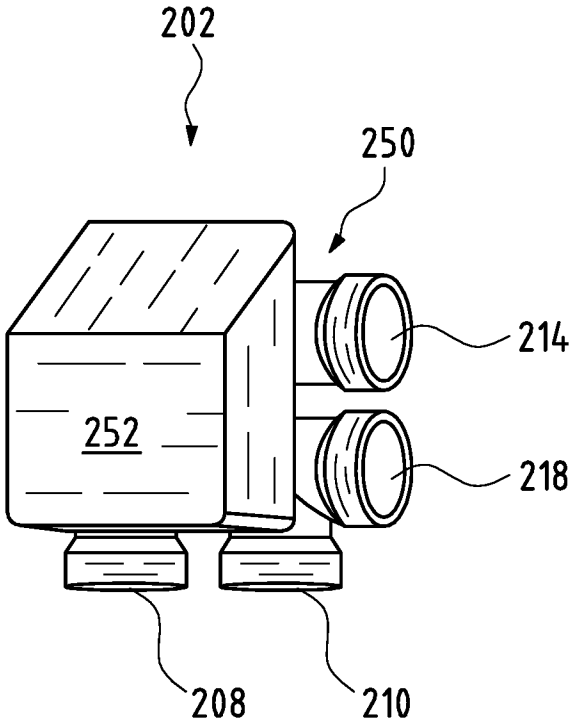
FIG. 4 is a perspective view of the main module of the manifold according to FIGS. 2 and 3.

FIGS. 2 and 3 show the assembled arrangement of six load modules 204 on the main module 202 as are shown in FIGS. 4 and 5. One can recognize that a hydraulic manifold is thus created, which comprises six feed connections 258 and six return connections 260 for six load circuits. All six load modules 204 are designed in an identical manner. The last load module 204, i.e. the one which is distant or away from the main module 202, is closed by an end piece 262 at its second feed coupling 224 and its second return coupling 226.

Figure 6:
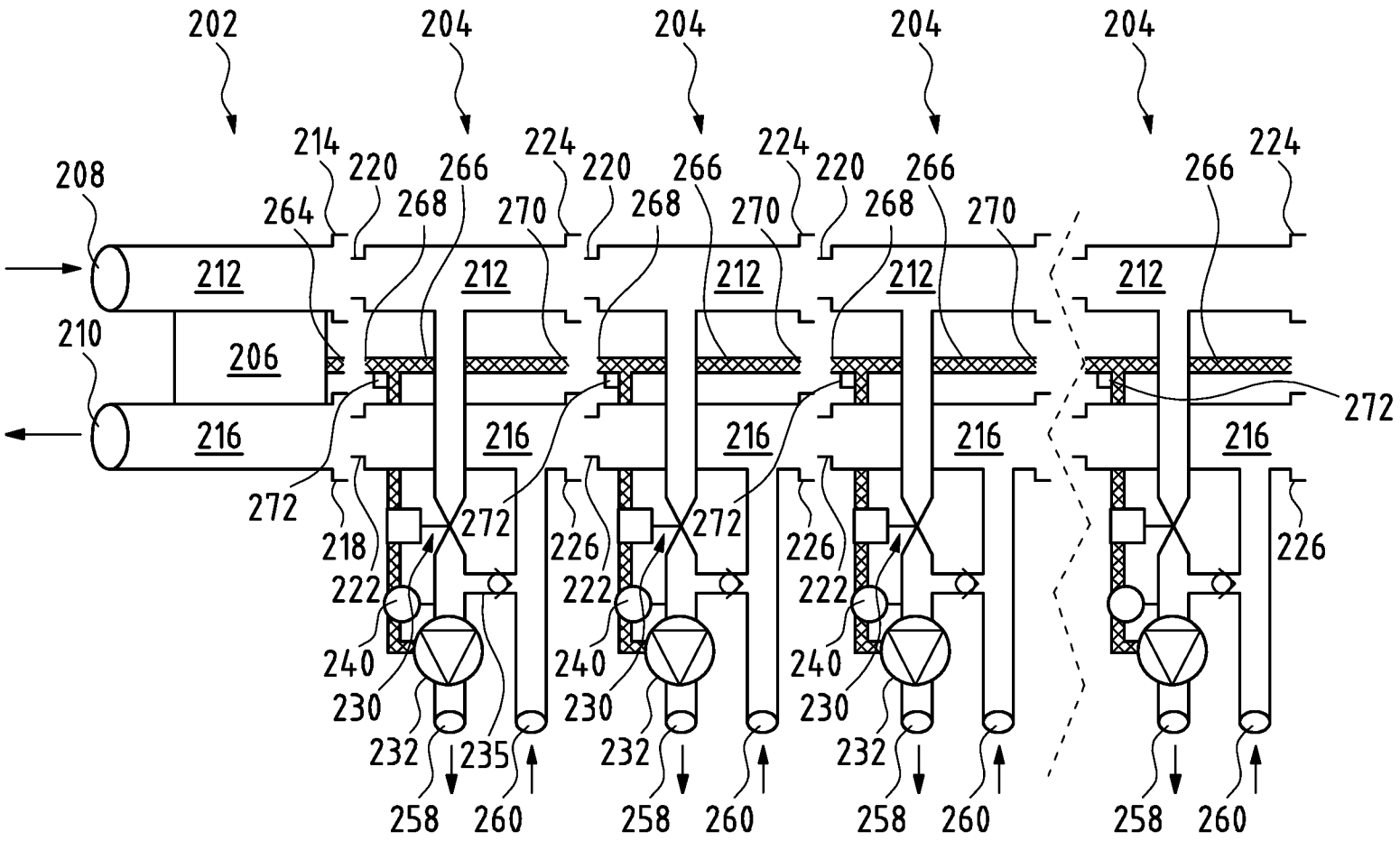
FIG. 6 is a schematic view showing the modular construction of the hydraulic manifold according to FIGS. 2 and 3, in the non-assembled condition.
Figure 7:
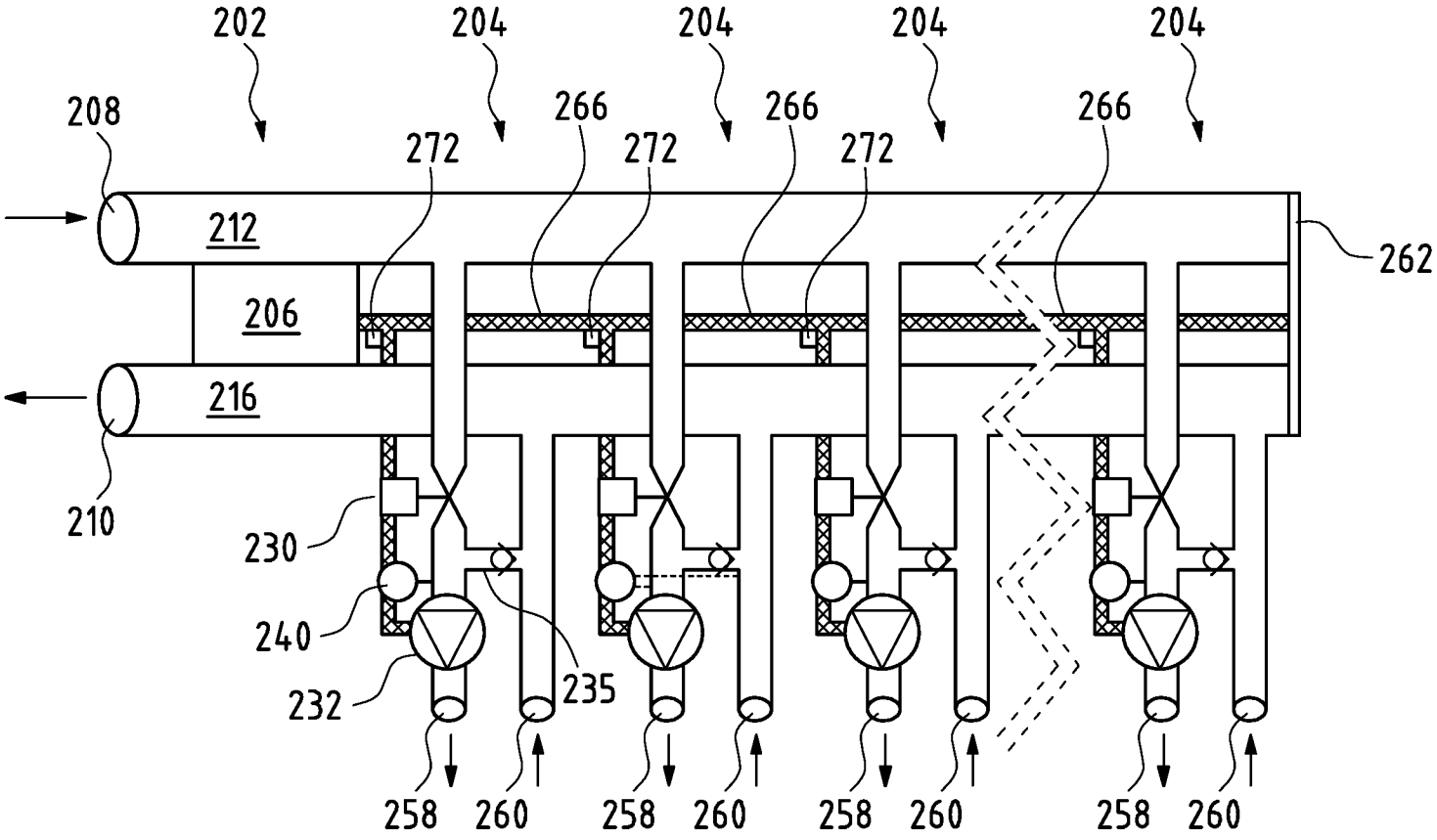
FIG. 7 is a schematic view showing the construction of the hydraulic manifold according to FIG. 6, in the assembled condition.

The flow paths of the thus coupled hydraulic manifold are shown once again in more detail in FIG. 7. FIG. 6 shows the construction according to FIG. 7, in the non-assembled condition of the load modules 204. Only the arrangement of four load modules 204 is shown in FIGS. 6 and 7 in a schematic manner, Apart from the described hydraulic connections and elements, the main module 202 as well as the load modules 204 comprises electrical or electronic components. As described, the load module comprises the electronic control device 206. This is connected in the main module 202 to an electrical connection plug 264. An electrical connection 266 is provided in each of the load modules 204 and at its first axial end ends in an electrical connection plug 268 and at its opposite axial end ends in an electrical connection plug 270. Thereby, the electrical connection plugs 268 and 270 are designed such that the electrical connection plug 268 can engage with the electrical connection plug 264 on the main module 202 or with an electrical connection plug 270 of an adjacent load module, in order to form an electric coupling and to create an electric connection between the load module 204 and an adjacent load module 204 or the main module 202. In the inside of the load module 204, in each case the drive of the regulating valve 230, the temperature sensor 240 as well as the circulation pump 232 are connected to the electrical connection 266 which is designed as a data bus. The electrical connection 266 thereby serves for the energy transmission to these components and furthermore for the signal transmission to these components or from these components to the manifold control device 206 in the main module 202.

If a further load module 204 is stuck onto a load module 204, then an energy supply also to this subsequent load module 204 from the main module 202 is created by way of the electrical connection created via the connection plugs 268 and 270, as well as a data transmission from the main module 202 to this further load module 204 via the intermediately lying load module or load modules 204. The addressing of the individual load modules 204 can be effected via a model control device 272 in each module 204. The module control device 272 serves for the data communication with the central manifold device 206. For this, an address is allocated to each module control device 272, i.e. thus to each load module 204. This can be effected in an automatic manner by way of the manifold control device 206 on connecting the respective load module 204. Then the regulating valve 230 and the circulation pump 323 in each load module 204 can be individually activated via the address and the module control device 272, by the manifold control device 206, in order to effect a temperature regulation or volume flow regulation for the connected load circuit. The exit signal of the temperature sensor 240 and, as the case may be, of the temperature sensor 242 is fed back via the module control device 272 to the manifold control device 206 and from there can be incorporated into the regulation of the respective load module 204.

Room thermostats 274 are provided in the rooms to be thermally regulated (see FIG. 1), in order to permit a regulation dependent on room temperature. The room thermostats 274 communicate with a communication interface 276 of the control device 206. A desired nominal temperature can be set at the room thermostats 274. The room thermostat 274 sends a corresponding signal to the communication interface 276 of the control device 206, given a deviation of the actual temperature from this desired temperature. This control device thereupon activates the load circuit 228 associated with the room by way of switching on the circulation pump 232 in the associated load module 204. The described temperature regulation or flow regulation for the associated load circuit 228 is subsequently effected. If the inputted desired temperature at the room thermostat 274 is reached, then the room thermostat 274 sends a corresponding signal to the communication interface 276 of the control device 206. This control device thereupon deactivates the associated load circuit 228, i.e. switches off the load circuit 228 situated in the respective room, by way of the circulation pump 232 in the associated load module 204 being switched off.

While specific embodiments of the invention have been shown and described in detail to illustrate the application of the principles of the invention, it will be understood that the invention may be embodied otherwise without departing from such principles.

What is claimed is:

1. A hydraulic manifold for a hydraulic heating and/or cooling system, the hydraulic manifold comprising:

a feed conduit comprising at least one feed connection;

a return conduit comprising at least one return connection, for the connection of a load circuit;

a plurality of load modules wherein each load module serves for connection to the load circuit, in each of the plurality of load modules a section of the feed conduit with the feed connection is formed and a section of the return conduit with the return section are formed, each load module comprising at least one mixing device with a pump and with a regulating valve to admix fluid from the return connection to fluid flow from the feed conduit to the load circuit, the mixing device being configured to individually adapt a feed temperature for independent rooms thermally regulated by the independent load circuits, wherein the section of the feed conduit and the section of the return conduit each comprise an additional contact for connection with a further load module;

a central manifold control device controlling at least one of the regulating valves and the pump of each of the plurality of load modules, to set a temperature and/or the flow of the fluid flow through the feed connection of each load module;

at least one temperature sensor arranged in each of the plurality of load modules and signal-connected to the central manifold control device;

a communication interface provided in each of the plurality of load modules and connected to the manifold control device;

a main module comprising a hydraulic module portion and an electronics housing directly connected to the hydraulic module portion, the central manifold control device being arranged in the electronics housing and the hydraulic module portion comprising an entry for the feed conduit and an exit for the return conduit, wherein the main module comprises an energy supply for the pump and the regulating valve in one of the plurality of load modules.

2. A hydraulic manifold according to claim 1, wherein: the plurality of load modules are releasably connected to one another with the sections of the feed conduit each connected to one another, and the sections of the return conduit each connected to one another.

3. A hydraulic manifold according to claim 1, wherein the plurality of load modules are connected releasably to the main module.

4. A hydraulic manifold according to claim 1, further comprising a data bus wherein the manifold control device is signal-connected to the load modules via the data bus.

5. A hydraulic manifold according to claim 1, further comprising a main module comprising at least one of an entry for the feed conduit and an exit for the return conduit, wherein the at least one load module is connected releasably to the main module, wherein the central manifold control device is arranged in the main module.

6. A hydraulic manifold according to claim 1, wherein: the at least one temperature sensor is signal-connected to the central manifold control device via a data bus.

7. A hydraulic manifold according to claim 6, wherein the temperature sensor in the one load module is arranged in a manner such that it detects the temperature of a fluid flowing through the feed connection.

8. A hydraulic manifold according to claim 1, wherein the central manifold control device sets a temperature of a fluid flow through the feed connection by way of activating the regulating valve in one of the plurality of load modules.

9. A hydraulic manifold according to claim 1, wherein the central manifold control device sets a fluid flow through the feed connection by way of activating the pump in one of the plurality of load modules.

10. A hydraulic manifold according to claim 1, wherein the central manifold control device comprises at least one communication interface for receiving signals from an external control element comprising a room thermostat.

11. A hydraulic manifold according to claim 1, wherein the pump in one of the plurality of load modules is arranged in a flow path between a mixing point, in which a flow path from the feed conduit and a flow path from the return connection meet, and the feed connection.

12. A hydraulic manifold according to claim 1, wherein the regulating valve is arranged in one of:

a flow path from the return connection to a mixing point, in which a flow path from the feed conduit and the flow path from the return connection meet; and the flow path from the feed conduit to the mixing point.

13. A hydraulic manifold according to claim 1, wherein the regulating valve is a motor driven valve.

14. A hydraulic manifold according to claim 1, wherein the main module comprises an enclosed interior space, the central manifold control device being arranged in the enclosed interior space.

15. A hydraulic manifold according to claim 1, wherein the central manifold control device is surrounded by the main module.

16. A hydraulic manifold for a hydraulic heating and/or cooling system with a feed conduit and a return conduit, the hydraulic manifold comprising:

a plurality of load modules, wherein each load module serves for connection to a load circuit and each load module comprises:

a feed conduit section forming a portion of the feed conduit;

a feed connection connected to the feed conduit section;

a return conduit section forming a portion of the return conduit;

a return connection connected to the return conduit; and each load module comprising:

a mixing device comprising a pump and a regulating valve to admix fluid from the return connection to fluid flow from the feed conduit to the load circuit, the mixing device being configured to individually adapt a feed temperature for independent rooms thermally regulated by the load circuits, wherein the feed conduit section and the return conduit section of each comprise a connection interface for connection with a further load module;

a temperature sensor;

a central manifold control device controlling at least one of the regulating valves and the pump of each of the plurality of load modules, to set a temperature and/or the flow of the fluid flow through the feed connection of each load module;

a data bus wherein the central manifold control device is signal-connected to the mixing devices and the temperature sensors of the load modules via the data bus, the data bus extends over all load modules and permits signals to be led further to other load modules and each load module comprises a communication interface connected to the central manifold control device;

a main module comprising a hydraulic module portion and an electronics housing directly connected to the hydraulic module portion, the central manifold control device being arranged in the electronics housing and the hydraulic module portion comprising an entry for the feed conduit and an exit for the return conduit, wherein the main module comprises an energy supply for the pump and the regulating valve in one of the plurality of load modules.

17. A hydraulic manifold according to claim 16, wherein one of the plurality of load modules is connected releasably to the main module.

18. A hydraulic manifold according to claim 16, wherein the main module comprises an enclosed interior space, the central manifold control device being arranged in the enclosed interior space.

19. A hydraulic manifold according to claim 16, wherein the central manifold control device is surrounded by the main module.

20. A load module for a hydraulic manifold of a hydraulic system, the hydraulic system having a feed conduit, a return conduit, a manifold control device, a load circuit connected to each load module and a main module comprising an electronics housing with the manifold control device arranged therein and a hydraulic module portion comprising an entry for the feed conduit and an exit for the return conduit, the electronics housing being directly connected to the hydraulic module portion, wherein the main module comprises an energy supply for the pump and the regulating valve in one of the plurality of load modules, the load module comprising:

a feed conduit section forming a portion of the feed conduit of the hydraulic system, said feed conduit section having first and second ends;

a return conduit section forming a portion of the return conduit of the hydraulic system, said return conduit section having first and second ends;

a module return line having one end connected to said return conduit section between said first and second ends of said return conduit section;

a load return connection connected to another end of said module return line, said load return connection being adapted to connect to a return line of a load of the hydraulic system;

a load feed connection adapted to connect to a feed line of the load of the hydraulic system;

a mixing device comprising a pump and a regulating valve to admix fluid from said module return line with fluid from said feed conduit section taken between said first and second ends of said feed conduit section, and deliver said admix fluid to said load feed connection, the mixing device being configured to individually adapt a feed temperature for independent rooms thermally regulated by the load circuits;

a first manifold interface connected to said first ends of said feed conduit section and connected to said return conduit section;

a second manifold interface connected to said second ends of said feed conduit section and connected to said return conduit section, said second manifold interface being configured to connect with a first manifold interface of an adjacent load module;

a temperature sensor configured to signal-connect to a manifold control device;

a communication interface connected to the manifold control device.

* * * * *